US005820819A

United States Patent [19]

Tanabe et al.

[11] Patent Number: 5,820,819

[45] Date of Patent: Oct. 13, 1998

[54] STEEL FOR CHIMNEY OR GAS DUCT, EXCELLENT IN PITTING RESISTANCE AND RUST ADHESION

[75] Inventors: Koji Tanabe; Hidesato Mabuchi; Yukio Tomita; Akira Usami, all of Futtsu; Katsutoshi Hashima, Hiroshima; Hiroshi Kondo, Hiroshima; Ryuichiro Ebara, Hiroshima; Yoshikazu Yamada, Hiroshima; Kazuhide Yamauchi; Masuo Matsumoto, both of Tokyo, all of Japan

[73] Assignees: Nippon Steel Corporation; Mitsubishi Jukogyo Kabushiki Kaisha, both of Tokyo, Japan

[21] Appl. No.: 697,187

[22] Filed: Aug. 20, 1996

[30] Foreign Application Priority Data

Aug. 25, 1995 [JP] Japan ..... 7-217328

[51] Int. Cl.[6] ..... C22C 38/14; C22C 38/28; C22C 38/50

[52] U.S. Cl. ..... 420/112; 420/110; 420/109; 420/126

[58] Field of Search ..... 420/112, 110, 420/109, 126

[56] References Cited

U.S. PATENT DOCUMENTS

| | | | |
|---|---|---|---|
| 3,899,368 | 8/1975 | Waid et al. | 420/112 |
| 4,957,701 | 9/1990 | Masuyama et al. | 420/110 |

FOREIGN PATENT DOCUMENTS

| | | | |
|---|---|---|---|
| 6017055 | 1/1983 | Japan | 420/112 |
| 2-170946 | 7/1990 | Japan . | |
| 7-286241 | 10/1995 | Japan . | |
| 8-144012 | 6/1996 | Japan . | |

OTHER PUBLICATIONS

Nippon Steel Corp.'s catalog entitled "Sulfuric Acid Dew Point Corrosion Resistant Steel S–TEN", Cat. No. AC107, Version Jul. 1992.

Nippon Steel Corp.'s catalog entitled "Sulfuric Acid Dew Point Corrosion Registant Steel YUS260", Cat. No. SS109, Version Jan. 1991.

Mitsubishi Heavy Industries Technical Report, vol. 27, No. 5, Sep. 1990–9.

*Primary Examiner*—Deborah Yee

*Attorney, Agent, or Firm*—Kenyon & Kenyon

[57] ABSTRACT

The present invention has an object to provide a steel for a chimney or a gas duct, which is excellent in pitting resistance and rust adhesion in a corrosive environment caused by combustion waste gas in a plant in which the combustion of natural gas occurs. Pitting resistance and rust adhesion are remarkably improved in the steel of the present invention which steel is prepared by using a 5% Cr steel as the base, while reducing an impurity sulfur to not more than 0.010 wt. %, adding titanium within a range of 0.005 to 0.05 wt. %, and further adding nickel alone within a range of 1.0 to 2.5 wt. %, or adding molybdenum alone within a range of 0.10 to 1.0 wt. %, or adding in combination therewith trace amount of copper or molybdenum within a range of 0.10 to 1.0 wt. %.

8 Claims, No Drawings

STEEL FOR CHIMNEY OR GAS DUCT, EXCELLENT IN PITTING RESISTANCE AND RUST ADHESION

FIELD OF THE INVENTION

The present invention relates to a steel for a chimney or a gas duct which steel is used, in a plant for combustion of natural gas, as a welded structural member required to be excellent in corrosion resistance, and more particularly, in pitting resistance and rust adhesion.

BACKGROUND OF THE INVENTION

In a plant such as a thermal power plant, in general, combustion waste gas produced in a boiler flows through a desulfurizer, a denitrifier, an electrostatic dust collector, an air preheater, a gas duct and other facilities to a chimney and is released to the surrounding air.

For the purpose of protecting structural members such as a cylinder made of an ordinary steel from corrosion caused by combustion waste gas, there has been mainly used a method of providing a lining on the inner surface of a gas duct or a chimney which lining mainly comprises an inorganic material such as a castable, i.e., a process described in the Mitsubishi Heavy Industries technical Report, Vol. 27, No. 5, September 1990-9, for example.

On the other hand, there increase cases where a sulfuric acid dew point corrosion resistant low-alloy steel is used as a steel material for the inner cylinder of a chimney or a gas dust, as described in Nippon Steel Corporation's catalog entitled "Sulfuric Acid Dew Point Corrosion Resistant Steel S-TEN," Cat. No. AC107, Version July 1992, in place of the inorganic lining material as described above.

On purpose that a gas duct or chimney becomes free of maintenance, austenitic stainless steels exhibiting an excellent corrosion resistance as a lining material for a chimney were developed and were practically used as described, for example, in Japanese Patent Unexamined Publication No. 2-170,946 and in Nippon Steel's catalog "Sulfuric Acid Dew Point Corrosion Resistant Stainless Steel YUS260" Cat. No. SS 109, version January 1991.

The present inventors developed a corrosion resistant low-alloy steel (Japanese Patent Application No. 6-226,768) and a steel for a chimney or a gas duct for combustion of natural gas (Japanese Patent Application No. 6-226,769) both of which steels can omit the use of an inorganic lining. These are weldable steels for a chimney or a gas duct for combustion of natural gas, excellent in overall corrosion resistance and pitting resistance.

However, in a case where the above-mentioned ordinary steel is lined with an inorganic material, or where a sulfuric acid dew point corrosion resistant steel is used, or where a highly corrosion-resistant stainless clad steel is used, there has been caused such a problem as it is impossible to greatly reduce the construction cost.

More specifically, in the case where a lining of an inorganic material is provided on the ordinary steel, exposure of the substrate steel caused by the exfoliation and/or falling-off of the inorganic lining during service acts to cause the rapid corrosion of the substrate steel. It was therefore necessary to periodically repair the inorganic lining, so that there had been such problems as, in addition to the installation cost at the time of the construction, there arise a cost for this repair (i.e., maintenance cost) and another cost caused by increase of fixed charge occurring when power generation amount decreases during temporary interruption of plant operation for repair.

Further, even in a case where a sulfuric acid dew point corrosion resistant low-alloy steel is used, there remains such a fear as both rust produced by highly corrosive environment and deposits (which may cause rust) such as acidic ammonium sulfate and steam peel off and fall down, and may be discharged from the chimney, together with combustion waste gas. It was therefore necessary to take measures such as installation of a filter or a dust collector in the chimney, thus requiring additional costs. Particularly in a plant for combustion of natural gas, there occurred a large amount of exfoliative rust, requiring a higher cost for environmental control because the sulfuric acid dew point corrosion resistant low-alloy steel had a corrosion resistance only about twice as high as that of an ordinary steel.

Even in another case of reducing the maintenance cost through the use of a highly corrosion-resistant stainless clad steel product, the high cost of the steel product itself had led to an increased initial construction cost, or the welding operations of the clad steel which were more complicated than in an ordinary steel resulted in the need for special and expensive welding operations.

Also, in the case of the above-mentioned steel produced for a chimney or a gas duct used regarding combustion of natural gas, although it is sufficient in the properties of corrosion resistance and pitting resistance, there had still remained a fear that, similarly to the case of the sulfuric acid dew point corrosion resistant low-alloy steel, both rust produced by highly corrosive environment and deposits (which may cause rust) such as acidic ammonium sulfate and steam peel off and fall down, and may be discharged from the chimney, together with combustion waste gas. It was therefore necessary to take measures such as installation of a filter or a dust collector in the chimney, thus requiring additional costs.

SUMMARY OF THE INVENTION

The present invention was developed with a view to solving these problems, and has an object to provide a structural steel for welding which steel is usable for a chimney or a gas duct and which steel can make it unnecessary to provide the lining on the inner cylinder with an inorganic material in a corrosive environment caused by combustion waste gas of a plant for combustion of natural gas, the steel being provided with a corrosion resistance, particularly pitting resistance and rust adhesion more than four times as high as those of the above-mentioned sulfuric acid dew point corrosion resistant low-alloy steel, and the steel is far less expensive than the stainless clad steel.

The present inventors performed various experiments to solve the problems as described above, and obtained the following findings: in a case where a 5% Cr steel is used as a basic alloy, both pitting resistance and rust adhesion can be remarkably improved by the steps of: reducing the content of sulfur which is an impurity to down to 0.010 wt. % or less; adding titanium in an amount within a range of from 0.005% to 0.05 wt. %; and adding nickel alone in an amount within a range of from 1.0 to 2.5 wt. %, or molybdenum alone in an amount within a range of from 0.10 to 1.0 wt. %, or both copper and molybdenum each of which is within a range of from 0.10 to 1.0 wt. %.

More particularly, mechanical properties appropriate for a structural member can be provided by Si and Mn both contained in the steel, and at the same time, corrosion resistance can be improved through formation of a protective film on the surface of the steel by Cr of a content not less than 2.5 but less than 7.0 wt. %. Further, the content of phosphorus is reduced down to 0.025 wt. % or less which is detrimental to rust-adhesion because P acts to accelerate crystal growth of rust, the content of sulfur being reduced down to 0.025 wt. % or less which is detrimental to adhesion because S acts to considerably decrease cohesion of rust particles. In addition to these measures, nickel alone is added within a range of 1.0 to 2.5 wt. %, or molybdenum alone is added within a range of 0.10 to 1.0 wt. %, or both copper and molybdenum each of which is contained within a range of 0.10 to 1.0 wt. %, with the result that the rust adhesion of the steel can be remarkably improved.

According to the first aspect of the present invention, there is provided a steel for a chimney or a gas duct, excellent in pitting resistance and rust adhesion, which consists essentially, by weight, of:

carbon of 0.01 to 0.15%;

silicon of 0.01 to 0.5%;

manganese of 0.1 to 1.5%;

phosphorus up to 0.025%;

sulfur up to 0.010%;

chromium not less than 2.5 but less than 7.0%;

nickel of 1.0 to 2.5%;

titanium of 0.005 to 0.05%;

aluminum of 0.005 to 0.1%; and the balance being iron and incidental impurities.

According to the second aspect of the invention, there is provided a steel for a chimney or a gas duct, excellent in pitting resistance and rust adhesion, which contains in addition to the components of the steel of the first aspect, by weight, one selected from the group consisting of:

copper of 0.10 to 1.0%; and molybdenum of 0.10 to 1.0%.

According to the third aspect of the invention, there is provided a steel for a chimney or a gas duct, excellent in pitting resistance and rust adhesion, which consists essentially, by weight, of:

carbon of 0.01 to 0.15%;

silicon of 0.01 to 0.5%;

manganese of 0.1 to 1.5%;

phosphorus up to 0.025%;

sulfur up to 0.010%;

chromium not less than 2.5 but less than 7.0%;

nickel less than 1.0%;

titanium of 0.005 to 0.05%;

aluminum of 0.005 to 0.1%; at least one selected from the group consisting of copper of 0.10 to 1.0% and molybdenum of 0.10 to 1.0%; and the balance being iron and incidental impurities.

According to the fourth aspect of the invention, there is provided a steel for a chimney or a gas duct, excellent in pitting resistance and rust adhesion, which consists essentially, by weight of:

carbon of 0.01 to 0.15%;

silicon of 0.01 to 0.5%;

manganese of 0.1 to 1.5%;

phosphorus up to 0.025%;

sulfur up to 0.010%;

chromium of 2.5 to less than 7.0%;

molybdenum of 0.1 to 1.0%;

titanium of 0.005 to 0.05%;

aluminum of 0.005 to 0.1%; and the balance being iron and incidental impurities.

According to the fifth aspect of the invention, there is provided a steel for a chimney or a gas duct, excellent in pitting resistance and rust adhesion, which contains copper of 0.10 to 1.0 wt. % in addition to the components of the steel of the fourth aspect.

According to the sixth aspect of the invention, there is provided a steel for a chimney or a gas duct, excellent in pitting resistance and rust adhesion, which contains in addition to the components of the steel of any one of the first aspect to the fifth aspect, by weight, one or more selected from the group consisting of:

niobium of 0.005 to 0.1%;

vanadium of 0.005 to 0.1%; and tantalum of 0.001 to 0.1%, and/or contains boron of 0.0003 to 0.0050%.

According to the seventh aspect of the invention, there is provided a steel for a chimney or a gas duct, excellent in pitting resistance and rust adhesion, which contains in addition to the components of the steel of any one of the first aspect to the sixth aspect, by weight, one or more selected from the group consisting of:

REM of 0.0003 to 0.0050%;

calcium of 0.0003 to 0.06%; and zirconium of 0.0002 to 0.10%.

In this specification, the term "corrosion resistance" means an overall corrosion resistance evaluated by means of the average weight loss by corrosion (weight loss caused by corrosion per unit area). The term "pitting resistance" means resisting property to local corrosion, which is a property essential for a structural member and which is evaluated by means of the maximum corrosion depth. The term "rust" means both rust occurring as a result of corrosion of the surface of a steel, which rust is so-called scale, and deposits such as ammonium sulfate and steam which cause rust.

DETAILED DESCRIPTION OF THE PREFERRED EMBODIMENTS

Now, embodiments of the present invention are described.

First, the reasons of limiting the chemical composition of steel as set out in the present invention are explained below.

Carbon is an essential element which is added in an amount of at least 0.01 wt. % to ensure a sufficient strength. A carbon content more than 0.15 wt. % causes, however, deterioration of both weldability and corrosion resistance. The upper limit thereof is therefore up to 0.15 wt. %.

Addition of silicon in an amount of at least 0.01 wt. % is essential for deoxidation. However, since a silicon content more than 0.5 wt. % leads to deterioration of both toughness and weldability, the upper limit of silicon content is up to 0.5 wt. %.

Manganese is added in an amount of at least 0.1 wt. % for ensuring deoxidation and desulfurization effects and a sufficient strength. Addition of manganese more than 1.5 wt. % results, however, in a lower toughness although strength is improved. The manganese content is therefore up to 1.5 wt. %.

Phosphorus is present in steel as an impurity, however, a phosphorus content more than 0.025 wt. % accelerates crystal growth which in turn causes coarsening of particles, thus impairing rust adhesion and weldability. The phosphorus content is therefore limited to not more than 0.025 wt. %.

Sulfur is existent in steel as an impurity. A sulfur content more than 0.010 wt. % considerably reduces cohesive occurring among rust particles, impairs rust adhesion due to the forming of TiS which acts to decreases the amounts of solid-solution titanium and TiO both effective for improving rust adhesion, and further causes deterioration of corrosion resistance and toughness. The sulfur content is therefore limited to not more than 0.010 wt. %.

Chromium is an essential element having an important effect for reducing the weight loss by corrosion (=corrosion rate) per unit time. However, because a chromium content less than 2.5 wt. % accelerates corrosion, an amount of at least 2.5 wt. % Cr is added. In a chromium content not less than 7.0%, on the other hand, the effect thereof is saturated and leads to a large increase in cost. The upper limit is therefore less than 7.0%. The chromium content is therefore limited within a range of not less than 2.5 but less than 7.0 wt. %. Addition of chromium in an amount of at least 4.5 wt. % is particularly preferable for obtaining a remarkable effect, whereas addition more than 5.5 wt. % leads to deteriorate gas cutting ability. The chromium content is most preferably within a range of 4.5 to 5.5 wt. %.

Copper, nickel and molybdenum are elements necessary for improving pitting resistance and rust adhesion.

Addition of copper in an amount of at least 0.05 wt. % brings about improvement of pitting resistance, and the addition of Cu together with the addition of nickel of at least 0.10 wt. % results in a remarkable improvement of rust adhesion as well as the pitting resistance because of combined addition effect described below. The effect is more remarkable by the addition of at least 0.10 wt. % Cu, and the effect becomes saturated in a case where Cu content is more than 1.0 wt. %. To achieve improvement of both pitting resistance and rust adhesion, therefore, the copper content is limited within a range of 0.10 to 1.0 wt. %.

In any case of the combined addition of Ni and Cu and/or molybdenum or in the case of the single addition of Ni, the addition of nickel of at least 0.05 wt. % results in improvement of only pitting resistance. The effect on rust adhesion differs between (1) combined addition of both Ni and Cu and/or Mo and (2) single addition of nickel. The ranges of limitation regarding the content thereof are therefore as follows:

(1) combined addition with copper or molybdenum:

Combined addition of both not less than 0.10 wt. % Ni and not less than 0.10 wt. % Cu acts to accelerate the formation of amorphous rust, so that adhesion between rust and the steel substrate is greatly improved. Further, when there occurs dew concentration of water contained in combustion waste gas, deposite adhering to the surface layer of rust (most of which deposits are ammonium iron sulfate) and rust are resolved into the condensed water, and in the course of the drying thereof, ammonium iron sulfate and iron oxides are precipitated again, and re-precipitations having a high adhesion occur to thereby improve the adhesion of both the rust and the deposits. Because the combined addition of copper and nickel each in an amount of over 1.0 wt. % results only in saturated effect, the copper content and the nickel content is limited to be within ranges of from 0.10 to 1.0 wt. % and from 0.10 to 1.0 wt. %, respectively, for the purpose of improving both pitting resistance and rust adhesion.

(2) Single addition of nickel:

By adding nickel of at least 1.0 wt. %, rust adhesion at the interface defined between the steel substrate and rust is improved, and adhesion between the rust and deposits adhering to the surface layer of the rust is also improved because of such a mechanism as the Ni suppresses the diffusion of corrosive anions (chlorine and sulfate ions) into the steel substrate. Addition of Ni more than 2.5 wt. %, on the other hand, causes a much increase of cost and saturation of effect. The nickel content is therefore limited within a range of 1.0 to 2.5 wt. %.

Molybdenum is an element which can improve pitting resistance by the adding thereof in an amount of at least 0.1 wt. %. Regarding the addition of Mo there are two cases that is, (1) the single addition of molybdenum and (2) the combined addition of both Mo and Cu-Ni (or Ni alone), the functions of the cases (1) and (2) and the amount of the addition in these cases being the same each other. However, the case (2) is preferable in which a higher effect is brought about than in the case (1).

(1) Addition of molybdenum alone:

Addition of molybdenum in an amount not less than 0.1 wt. % acts to suppress acicularization of rust particles, thus remarkably improving rust adhesion, and brings about the re-dissolution of a part of rust in the surface layer thereof, which accelerates the reprecipitation of highly adhesive rust between deposits and rust, thus remarkably improving adhesion between rust and deposits. This effect is, however, saturated in a case of molybdenum content more than 1.0 wt. %. Thus, molybdenum content is therefore within a range of 0.1 to 1.0 wt. %.

(2) Addition of molybdenum together with Cu and Ni or together with Ni:

The combined addition of Mo, Cu and Ni or of Mo and Ni improves rust adhesion. However, because this effect is saturated at 1.0 wt. % Mo, the molybdenum content in this case is up to 1.0 wt. %.

Addition of titanium not less than 0.002 wt. % acts to fix carbon and nitrogen in steel and acts as a cathode site to thereby promote uniform dissolution of the alloy with the results that omnipresence of distribution of anodes and cathodes is suppressed, which improves pitting resistance. By adding Ti not less than 0.005 wt. %, a trace amount of solid-solution titanium and TiO becomes contained in eluted rust, so that a more uniform and finer nucleation of the rust is achieved, which improves rust adhesion. For the purpose of ensuring a satisfactory rust adhesion, it is essential to add titanium not less than 0.005 wt. %. The addition of Ti also acts to form TiO and TiN in the steel substrate, which TiO and TiN make the structure of a heat-affected zone fine in grain size at the time of welding to thereby improve the toughness of the steel. However, the adding of titanium more than 0.05 wt. % brings about only saturated effect regarding the improvement of pitting resistance and rust adhesion and causes such an adverse effect as to reduce toughness. Thus, titanium content is limited to be 0.005 to 0.05 wt. %.

Aluminum is an element added for the purpose of deoxidation to ensure a high toughness, which deoxidation effect becomes apparent when adding Al not less than 0.005 wt. %. However, the adding of Al more than 0.1 wt. % deteriorates toughness at a welding heat affected zone. Thus, aluminum content is limited to be 0.005 to 0.1 wt. %.

Niobium and vanadium each added in an amount of not less than 0.005% have effects of ensuring strength and toughness, and at the same time, of improving adhesion between the substrate steel and rust. However, the addition of each of Nb and V each more than 0.1 wt. %, leads to a decrease in toughness. The content of each of niobium and vanadium contents is therefore limited to be 0.005 to 0.1 wt. %.

Tantalum is an element having effects similar to those of niobium and vanadium when added in an amount not less than 0.001 wt. %, that is, having effects of ensuring strength and toughness while improving adhesion between the substrate steel and rust. However, addition of tantalum more than 0.1 wt. % results in a decrease in toughness. The tantalum content is therefore limited to be 0.001 to 0.1 wt. %.

The addition of boron not less than 0.0003 wt. % improves rust adhesion, hardenability, strength and toughness. This effect becomes saturated with a boron content of more than 0.0050 wt. %. The boron content is therefore limited to be 0.0003 to 0.0050 wt. %.

REM is an element which improves toughness and which promotes the size-fining of rust particles, so that it improves rust adhesion. These functions, which are valid by the addition of REM not less than 0.0003 wt. %, become saturated even when added in an amount more than 0.0050 wt. %. The REM content is therefore limited to be 0.0003 to 0.0050 wt. %.

Calcium is an element effective for making sulfur harmless by fixing sulfur into CaS which sulfur is detrimental to rust adhesion, and effective also for improving lamellatea resistance. These effects are brought about by addition of Ca not less than 0.0003 wt. %, however, the effects become saturated when the content of Ca is more than 0.06 wt. %. The calcium content is therefore limited to be 0.0003 to 0.06 wt. %.

Zirconium improves toughness, and promotes the conversion of rust into an amorphous state because of its catalyst-high effect when zirconium is present in a trace amount in the rust, thus further improving adhesion between the substrate steel and rust. These functions is brought about by an addition of Zr not less than 0.0002 wt. %, whereas addition of Zr more than 0.10 wt. % leads to saturation of effects. The zirconium content is therefore limited to be 0.0002 to 0.10 wt. %.

Nitrogen is an element which forms nitrides such as TiN. In a case where nitrogen content is not more than 0.070 wt. %, it becomes possible to keep a necessary amount of solid-solution titanium in steel, so that rust adhesion is further improved. The nitrogen content is therefore preferably limited to be up to 0.070 wt. %.

The expression "the effect is saturated" as used hereabove means such a phenomena as an effect brought about by the addition of an alloy additive does not increase any more even when the amount of the addition of the additive increases.

DETAILED DESCRIPTION OF THE PREFERRED EMBODIMENTS

Now, the present invention is described by means of embodiments.

Table 1, Table 2 (continuation 1 of Table 1), Table 3 (continuation 2 of Table 1), Table 4 (continuation 3 of Table 1), Table 5 (continuation 4 of Table 1), Table 6 (continuation 5 of Table 1), Table 7 (continuation 6 of Table 1), Table 8 (continuation 7 of Table 1), Table 9 (continuation 8 of Table 1), Table 10 (continuation 9 of Table 1), Table 11 (continuation 10 of Table 1), Table 12 (continuation 11 of Table 1), Table 13 (continuation 12 of Table 1), Table 14 (continuation 13 of Table 1), Table 15 (continuation 14 of Table 1), Table 16 (continuation 15 of Table 1), Table 17 (continuation 16 of Table 1), Table 18 (continuation 17 of Table 1), Table 19 (continuation 18 of Table 1), Table 20 (continuation 19 of Table 1), Table 21 (continuation 20 of Table 1), Table 22 (continuation 21 of Table 1), Table 23 (continuation 22 of Table 1), and Table 24 (continuation 23 of Table 1) show chemical compositions of tested steels. Comparative Example C01 covers a commercially available sulfuric acid dew point corrosion resistant low-alloy steel, and Comparative Example C2 covers a rolled steel product for welded structures (JIS G3141 SM400). As regards examples other than C01 and C02, a vacuum-melted ingot of 50 kg was hot-rolled to obtained steel sheets having thicknesses of 15 mm and 6 mm, whereby these samples were obtained.

Actual plant exposure test pieces (each 100×100×3t) and dip-and-dry corrosion test pieces (each 120×120×3t) were sampled from the 6 mm thick steel sheets. Reproduced heat cycle test pieces (each 12×12×70) were sampled from the 15 mm thick steel sheets.

(1) Dip and dry corrosion test (hereafter abbreviated as "D&D" in the tables):

As a corrosion test simulating actual corrosion environments of a chimney or a gas duct, a dip and dry corrosion test (a corrosion accelerating/evaluating test based on repetition of a cycle comprising dipping into a predetermined solution, drawing out and drying) was performed under conditions as shown in Table 25. After the test, the weight of peeled-off rust and deposits was determined through a peeling-off test by use of a tape to evaluate adhesion of rust and deposits. The weight after rust removal was measured to determine the weight loss by corrosion. The maximum corrosion depth was measured to evaluate pitting resistance. The weight of peeled-off rust and deposits, weight loss by corrosion and the maximum corrosion depth were expressed and evaluated in terms of relative values obtained when those in Comparative Example C01 (sulfuric acid dew point corrosion resistant low-alloy steel) are made to be 100.

(2) Actual plant exposure test:

A test piece rack was installed in the chimney of an LNG-burning plant. The test piece was sampled after the lapse of 24 months. Adhesion of rust and deposits, corrosion resistance and pitting resistance were evaluated in the same manner as above.

(3) Evaluation of toughness of welded joint:

A heat cycle test piece was sampled from the thickness center of a tested steel plate having a thickness of 15 mm, which test piece was subjected to a heat cycle reproduction test (equivalent to SAW 45 kJ/cm; peak temperature: 1,400° C.; cooling rate between 800° and 500° C.: 25 seconds). After the test, a 2 mm V-notch Charpy impact test piece was sampled to be subjected to a Charpy impact test at 0° C.

The results of the above-mentioned tests (1) to (3) in the Examples of the present invention are similarly shown in Tables 1 to 24.

TABLE 1

| | No. | C | Si | Mn | P | S | Cr | Ni | Mo |
|---|---|---|---|---|---|---|---|---|---|
| Comparative Example | C01 | 0.12 | 0.290 | 0.50 | 0.011 | 0.006 | 0.01 | 0.18 | — |
| | C02 | 0.12 | 0.190 | 0.85 | 0.013 | 0.009 | 0.01 | 0.02 | — |
| | C03 | 0.18 | 0.320 | 1.10 | 0.005 | 0.007 | 3.40 | 1.50 | — |
| | C04 | 0.04 | 0.008 | 1.00 | 0.025 | 0.005 | 4.20 | 1.30 | — |
| | C05 | 0.07 | 0.600 | 1.30 | 0.011 | 0.002 | 4.80 | 0.30 | — |
| | C06 | 0.12 | 0.110 | 0.08 | 0.011 | 0.006 | 3.10 | 1.30 | — |
| | C07 | 0.14 | 0.360 | 1.80 | 0.016 | 0.008 | 5.70 | 2.40 | — |
| | C08 | 0.12 | 0.220 | 0.90 | 0.030 | 0.007 | 3.20 | 2.50 | — |
| | C09 | 0.05 | 0.210 | 1.30 | 0.017 | 0.012 | 3.40 | 1.20 | — |
| | C10 | 0.06 | 0.450 | 0.40 | 0.025 | 0.006 | 2.00 | 2.10 | — |
| | C11 | 0.02 | 0.440 | 0.20 | 0.025 | 0.006 | 7.80 | 2.00 | — |
| | C12 | 0.04 | 0.320 | 1.10 | 0.005 | 0.007 | 3.40 | 0.040 | — |
| | C13 | 0.09 | 0.200 | 0.30 | 0.006 | 0.009 | 5.60 | 0.30 | — |
| | C14 | 0.11 | 0.080 | 0.50 | 0.005 | 0.005 | 3.50 | 0.51 | — |
| | C15 | 0.01 | 0.310 | 1.40 | 0.012 | 0.005 | 4.20 | 1.00 | — |
| | C16 | 0.07 | 0.380 | 1.50 | 0.015 | 0.001 | 3.50 | 2.40 | — |
| | C17 | 0.07 | 0.100 | 1.30 | 0.011 | 0.002 | 4.80 | 0.4 | — |

TABLE 1-continued

| No. | C | Si | Mn | P | S | Cr | Ni | Mo |
|---|---|---|---|---|---|---|---|---|
| C18 | 0.12 | 0.110 | 0.08 | 0.011 | 0.006 | 3.10 | — | 0.20 |
| C19 | 0.04 | 0.360 | 1.80 | 0.016 | 0.008 | 5.70 | — | 1.00 |

TABLE 2

(Continuation 1 of Table 1)

| | No. | Ti | Al | Cu | Nb | V | Ta | Zr | B |
|---|---|---|---|---|---|---|---|---|---|
| Comparative Example | C01 | — | 0.026 | 0.30 | — | — | — | — | — |
| | C02 | — | 0.019 | 0.01 | — | — | — | — | — |
| | C03 | 0.030 | 0.064 | — | — | — | — | — | — |
| | C04 | 0.028 | 0.028 | — | — | — | — | — | — |
| | C05 | 0.082 | 0.036 | — | — | — | — | — | |
| | C06 | 0.034 | 0.086 | — | — | — | — | — | — |
| | C07 | 0.036 | 0.074 | — | — | — | — | — | — |
| | C08 | 0.038 | 0.091 | — | — | — | — | — | — |
| | C09 | 0.046 | 0.039 | — | — | — | — | — | — |
| | C10 | 0.040 | 0.050 | — | — | — | — | — | — |
| | C11 | 0.033 | 0.041 | — | — | — | — | — | — |
| | C12 | 0.030 | 0.064 | 0.15 | — | — | — | — | — |
| | C13 | 0.004 | 0.078 | 0.31 | — | — | — | — | — |
| | C14 | 0.060 | 0.025 | — | — | — | — | — | — |
| | C15 | 0.049 | 0.004 | — | — | — | — | — | — |
| | C16 | 0.075 | 0.120 | — | — | — | — | — | — |
| | C17 | 0.082 | 0.036 | 0.08 | — | — | — | — | — |
| | C18 | 0.034 | 0.086 | — | — | — | — | — | — |
| | C19 | 0.036 | 0.074 | — | — | — | — | — | — |

TABLE 3

(Continuation 2 of Table 1)

| | No. | REM | Ca | N | Others | Rust weight in D&D | Rust weight in chimney exposure |
|---|---|---|---|---|---|---|---|
| Comparative Example | C01 | — | — | 0.0075 | Sb:0.096 | 100 | 100 |
| | C02 | — | — | 0.0090 | — | 144 | 135 |
| | C03 | — | — | 0.0050 | — | 9 | 13 |
| | C04 | — | — | 0.0090 | — | 9 | 8 |
| | C05 | — | — | 0.0055 | — | 9 | 8 |
| | C06 | — | — | 0.0090 | — | 7 | 13 |
| | C07 | — | — | 0.0100 | — | 10 | 15 |
| | C08 | — | — | 0.0030 | — | 90 | 93 |
| | C09 | — | — | 0.0020 | — | 95 | 94 |
| | C10 | — | — | 0.0120 | — | 168 | 168 |
| | C11 | — | — | 0.0015 | — | 5 | 5 |
| | C12 | — | — | 0.0050 | — | 85 | 90 |
| | C13 | — | — | 0.0065 | — | 85 | 89 |
| | C14 | — | — | 0.0040 | — | 9 | 8 |
| | C15 | — | — | 0.0010 | — | 9 | 13 |
| | C16 | — | — | 0.0015 | — | 9 | 10 |
| | C17 | — | — | 0.0055 | — | 90 | 92 |
| | C18 | — | — | 0.0090 | — | 7 | 13 |
| | C19 | — | — | 0.0100 | — | 10 | 15 |

TABLE 4

(Continuation 3 of Table 1)

| | No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|---|
| Comparative Example | C01 | 100 | 100 | 100 | 100 | 8.5 |
| | C02 | 133 | 144 | 158 | 159 | 7.8 |

TABLE 4-continued (Continuation 3 of Table 1)

| | No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|---|
| Comparative Example | C03 | 10 | 9 | 10 | 9 | 0.5 |
| | C04 | 10 | 9 | 10 | 9 | 0.4 |
| | C05 | 10 | 9 | 10 | 9 | 0.7 |
| | C06 | 8 | 6 | 8 | 6 | 0.6 |
| | C07 | 6 | 8 | 6 | 8 | 0.9 |
| | C08 | 9 | 8 | 9 | 8 | 0.5 |
| | C09 | 99 | 95 | 99 | 95 | 1.9 |
| | C10 | 164 | 162 | 198 | 158 | 7.9 |
| | C11 | 7 | 6 | 7 | 6 | 2.1 |
| | C12 | 10 | 9 | 10 | 9 | 7.5 |
| | C13 | 14 | 13 | 14 | 13 | 7.5 |
| | C14 | 10 | 9 | 10 | 9 | 1.5 |
| | C15 | 10 | 9 | 10 | 9 | 1.4 |
| | C16 | 8 | 10 | 8 | 10 | 0.9 |
| | C17 | 10 | 9 | 10 | 12 | 7.0 |
| | C18 | 8 | 6 | 8 | 6 | 0.6 |
| | C19 | 6 | 8 | 6 | 8 | 0.9 |

TABLE 5

(Continuation 4 of Table 1)

| | No. | C | Si | Mn | P | S | Cr | Ni | Mo |
|---|---|---|---|---|---|---|---|---|---|
| Comparative Example | C20 | 0.12 | 0.220 | 0.90 | 0.030 | 0.007 | 3.20 | — | 0.30 |
| | C21 | 0.05 | 0.210 | 1.30 | 0.017 | 0.012 | 3.40 | — | 0.10 |
| | C22 | 0.06 | 0.450 | 0.40 | 0.025 | 0.006 | 2.00 | — | 0.10 |
| | C23 | 0.02 | 0.440 | 0.20 | 0.025 | 0.006 | 7.80 | — | 0.20 |
| | C24 | 0.12 | 0.170 | 1.20 | 0.021 | 0.003 | 6.10 | — | 0.08 |
| | C25 | 0.09 | 0.200 | 0.30 | 0.006 | 0.009 | 5.60 | — | 0.25 |
| | C26 | 0.11 | 0.080 | 0.50 | 0.005 | 0.005 | 3.50 | — | 0.42 |
| | C27 | 0.01 | 0.310 | 1.40 | 0.012 | 0.005 | 4.20 | — | 0.90 |
| | C28 | 0.11 | 0.080 | 0.50 | 0.005 | 0.005 | 3.50 | 0.54 | 0.42 |
| | C29 | 0.01 | 0.310 | 1.40 | 0.012 | 0.005 | 4.20 | 0.35 | 0.90 |
| | C30 | 0.07 | 0.380 | 1.50 | 0.015 | 0.001 | 3.50 | — | 0.70 |
| Example of Invention | J01 | 0.15 | 0.170 | 0.50 | 0.008 | 0.002 | 3.10 | 1.70 | — |
| | J02 | 0.01 | 0.010 | 0.70 | 0.007 | 0.004 | 3.60 | 1.70 | — |
| | J03 | 0.12 | 0.500 | 0.30 | 0.003 | 0.005 | 5.10 | 0.10 | — |
| | J04 | 0.06 | 0.100 | 0.10 | 0.004 | 0.004 | 5.40 | 1.90 | — |
| | J05 | 0.13 | 0.030 | 1.50 | 0.017 | 0.005 | 4.40 | 0.60 | — |
| | J06 | 0.08 | 0.080 | 0.30 | 0.025 | 0.009 | 3.40 | 2.00 | — |
| | J07 | 0.14 | 0.420 | 1.40 | 0.021 | 0.010 | 3.90 | 0.80 | — |
| | J08 | 0.12 | 0.440 | 0.90 | 0.024 | 0.004 | 2.50 | 2.50 | — |
| | J09 | 0.13 | 0.110 | 0.90 | 0.023 | 0.008 | 6.95 | 0.50 | — |

TABLE 6

(Continuation 5 of Table 1)

| | No. | Ti | Al | Cu | Nb | V | Ta | Zr | B |
|---|---|---|---|---|---|---|---|---|---|
| Comparative Example | C20 | 0.038 | 0.091 | — | — | — | — | — | — |
| | C21 | 0.046 | 0.039 | — | — | — | — | — | — |
| | C22 | 0.040 | 0.050 | — | — | — | — | — | — |
| | C23 | 0.033 | 0.041 | — | — | — | — | — | — |
| | C24 | 0.053 | 0.071 | — | — | — | — | — | — |
| | C25 | 0.004 | 0.078 | 0.31 | — | — | — | — | — |
| | C26 | 0.060 | 0.025 | — | — | — | — | — | — |
| | C27 | 0.049 | 0.004 | — | — | — | — | — | — |
| | C28 | 0.051 | 0.025 | — | — | — | — | — | — |
| | C29 | 0.049 | 0.004 | — | — | — | — | — | — |
| | C30 | 0.075 | 0.120 | — | — | — | — | — | — |
| | J01 | 0.045 | 0.047 | — | — | — | — | — | — |
| | J02 | 0.050 | 0.014 | — | — | — | — | — | — |
| Examples | J03 | 0.045 | 0.061 | — | — | — | — | — | — |
| | J04 | 0.012 | 0.022 | — | — | — | — | — | — |

TABLE 6-continued (Continuation 5 of Table 1)

| | No. | Ti | Al | Cu | Nb | V | Ta | Zr | B |
|---|---|---|---|---|---|---|---|---|---|
| of | J05 | 0.050 | 0.038 | — | — | — | — | — | — |
| Inven- | J06 | 0.050 | 0.011 | — | — | — | — | — | — |
| tion | J07 | 0.050 | 0.095 | — | — | — | — | — | — |
| | J08 | 0.045 | 0.053 | — | — | — | — | — | — |
| | J09 | 0.032 | 0.018 | — | — | — | — | — | — |

TABLE 7

(Continuation 6 of Table 1)

| | No. | REM | Ca | N | Others | Rust weight in D&D | Rust weight in chimney exposure |
|---|---|---|---|---|---|---|---|
| Com- | C20 | — | — | 0.0030 | — | 90 | 93 |
| para- | C21 | — | — | 0.0020 | — | 95 | 94 |
| tive | C22 | — | — | 0.0120 | — | 168 | 168 |
| Ex- | C23 | — | — | 0.0015 | — | 5 | 5 |
| ample | C24 | — | — | 0.0070 | — | 90 | 91 |
| | C25 | — | — | 0.0065 | — | 55 | 89 |
| | C26 | — | — | 0.0040 | — | 9 | 8 |
| | C27 | — | — | 0.0010 | — | 88 | 92 |
| | C28 | — | — | 0.0040 | — | 9 | 8 |
| | C29 | — | — | 0.0010 | — | 9 | 13 |
| | C30 | — | — | 0.0015 | — | 9 | 10 |
| Ex- | J01 | — | — | 0.0040 | — | 10 | 6 |
| amples | J02 | — | — | 0.0065 | — | 5 | 5 |
| of | J03 | — | — | 0.0055 | — | 5 | 15 |
| Inven- | J04 | — | — | 0.0090 | — | 8 | 7 |
| tion | J05 | — | — | 0.0050 | — | 9 | 13 |
| | J06 | — | — | 0.0030 | — | 9 | 10 |
| | J07 | — | — | 0.0020 | — | 9 | 8 |
| | J08 | — | — | 0.0120 | — | 7 | 13 |
| | J09 | — | — | 0.0015 | — | 10 | 15 |

TABLE 8

(Continuation 7 of Table 1)

| | No. | Weight loss by corro- sion in D&D | Weight loss by corrosion in chimney exposure | Max. erosion depth in D&D | Max. erosion depth in chimney exposure | Joint tough- ness vEO kgf-m |
|---|---|---|---|---|---|---|
| Com- | C20 | 9 | 8 | 9 | 8 | 0.5 |
| para- | C21 | 99 | 95 | 99 | 95 | 1.9 |
| tive | C22 | 164 | 162 | 124 | 128 | 7.9 |
| Ex- | C23 | 7 | 6 | 7 | 6 | 2.1 |
| ample | C24 | 15 | 11 | 15 | 11 | 7.9 |
| | C25 | 14 | 13 | 14 | 13 | 1.9 |
| | C26 | 10 | 9 | 10 | 9 | 1.5 |
| | C27 | 10 | 9 | 10 | 8 | 1.5 |
| | C28 | 10 | 9 | 10 | 11 | 1.5 |
| | C29 | 10 | 9 | 10 | 9 | 1.4 |
| | C30 | 8 | 10 | 8 | 10 | 0.9 |
| Ex- | J01 | 10 | 9 | 10 | 9 | 8.0 |
| amples | J02 | 7 | 6 | 7 | 11 | 9.0 |
| of | J03 | 10 | 10 | 11 | 12 | 9.0 |
| Inven- | J04 | 5 | 9 | 5 | 9 | 9.0 |
| tion | J05 | 10 | 9 | 10 | 13 | 9.0 |
| | J06 | 8 | 10 | 8 | 10 | 7.0 |
| | J07 | 10 | 9 | 12 | 9 | 9.5 |
| | J08 | 8 | 6 | 8 | 10 | 9.0 |
| | J09 | 6 | 8 | 8 | 8 | 9.0 |

TABLE 9

(Continuation 8 of Table 1)

| No. | C | Si | Mn | P | S | Cr | Ni | Mo |
|---|---|---|---|---|---|---|---|---|
| Example of Invention | | | | | | | | |
| J10 | 0.06 | 0.090 | 0.20 | 0.018 | 0.002 | 5.30 | 0.05 | — |
| J11 | 0.08 | 0.430 | 0.40 | 0.016 | 0.007 | 6.50 | 2.50 | — |
| J12 | 0.03 | 0.140 | 0.60 | 0.017 | 0.008 | 3.20 | 1.00 | 0.10 |
| J13 | 0.11 | 0.380 | 0.30 | 0.018 | 0.009 | 3.90 | 2.10 | 1.00 |
| J14 | 0.13 | 0.020 | 1.10 | 0.007 | 0.001 | 2.90 | 1.70 | — |
| J15 | 0.14 | 0.020 | 0.90 | 0.005 | 0.007 | 2.70 | 0.60 | — |
| J16 | 0.12 | 0.400 | 1.40 | 0.003 | 0.009 | 5.80 | 1.60 | — |
| J17 | 0.03 | 0.110 | 0.90 | 0.008 | 0.009 | 3.10 | 2.20 | — |
| J18 | 0.15 | 0.170 | 0.50 | 0.008 | 0.002 | 3.10 | — | 0.90 |
| J19 | 0.01 | 0.010 | 0.70 | 0.007 | 0.004 | 3.60 | — | 0.40 |
| J20 | 0.12 | 0.500 | 0.30 | 0.003 | 0.005 | 5.10 | — | 0.70 |
| J21 | 0.06 | 0.100 | 0.10 | 0.004 | 0.004 | 5.40 | — | 0.20 |
| J22 | 0.13 | 0.030 | 1.50 | 0.017 | 0.005 | 4.40 | — | 1.00 |
| J23 | 0.08 | 0.080 | 0.30 | 0.025 | 0.009 | 3.40 | — | 0.30 |
| J24 | 0.14 | 0.420 | 1.40 | 0.021 | 0.010 | 3.90 | — | 0.10 |
| J25 | 0.12 | 0.440 | 0.90 | 0.024 | 0.004 | 2.50 | — | 0.50 |
| J26 | 0.13 | 0.110 | 0.90 | 0.023 | 0.008 | 6.70 | — | 0.40 |
| J27 | 0.06 | 0.090 | 0.20 | 0.018 | 0.002 | 5.30 | 0.05 | 0.90 |
| J28 | 0.08 | 0.430 | 0.40 | 0.016 | 0.007 | 6.50 | 2.50 | 0.90 |
| J29 | 0.03 | 0.140 | 0.60 | 0.017 | 0.008 | 3.20 | — | 0.10 |

TABLE 10

(Continuation 9 of Table 1)

| No. | Ti | Al | Cu | Nb | V | Ta | Zr | B |
|---|---|---|---|---|---|---|---|---|
| Example of Invention | | | | | | | | |
| J10 | 0.038 | 0.097 | — | — | — | — | — | — |
| J11 | 0.033 | 0.051 | — | — | — | — | — | — |
| J12 | 0.050 | 0.047 | — | — | — | — | — | — |
| J13 | 0.045 | 0.054 | — | — | — | — | — | — |
| J14 | 0.005 | 0.084 | — | — | — | — | — | — |
| J15 | 0.050 | 0.065 | — | — | — | — | — | — |
| J16 | 0.050 | 0.005 | — | — | — | — | — | — |
| J17 | 0.050 | 0.100 | — | — | — | — | — | — |
| J18 | 0.045 | 0.047 | — | — | — | — | — | — |
| J19 | 0.050 | 0.014 | — | — | — | — | — | — |
| J20 | 0.045 | 0.061 | — | — | — | — | — | — |
| J21 | 0.012 | 0.022 | — | — | — | — | — | — |
| J22 | 0.050 | 0.038 | — | — | — | — | — | — |
| J23 | 0.050 | 0.011 | — | — | — | — | — | — |
| J24 | 0.050 | 0.095 | — | — | — | — | — | — |
| J25 | 0.045 | 0.053 | — | — | — | — | — | — |
| J26 | 0.032 | 0.018 | — | — | — | — | — | — |
| J27 | 0.038 | 0.097 | — | — | — | — | — | — |
| J28 | 0.033 | 0.051 | — | — | — | — | — | — |
| J29 | 0.050 | 0.047 | — | — | — | — | — | — |

TABLE 11

| No. | REM | Ca | N | Others | Rust weight in D&D | Rust weight in chimney exposure |
|---|---|---|---|---|---|---|
| Example of invention | | | | | | |
| J10 | — | — | 0.0070 | — | 8 | 8 |
| J11 | — | — | 0.0065 | — | 8 | 8 |
| J12 | — | — | 0.0040 | — | 9 | 12 |
| J13 | — | — | 0.0010 | — | 3 | 8 |
| J14 | — | — | 0.0050 | — | 9 | 8 |

TABLE 11-continued

| No. | REM | Ca | N | Others | Rust weight in D&D | Rust weight in chimney exposure |
|---|---|---|---|---|---|---|
| J15 | — | — | 0.0040 | — | 3 | 11 |
| J16 | — | — | 0.0050 | — | 8 | 8 |
| J17 | — | — | 0.0030 | — | 6 | 9 |
| J18 | — | — | 0.0020 | — | 10 | 6 |
| J19 | — | — | 0.0025 | — | 5 | 5 |
| J20 | — | — | 0.0015 | — | 5 | 15 |
| J21 | — | — | 0.0040 | — | 8 | 7 |
| J22 | — | — | 0.0010 | — | 9 | 13 |
| J23 | — | — | 0.0050 | — | 9 | 10 |
| J24 | — | — | 0.0040 | — | 9 | 8 |
| J25 | — | — | 0.0050 | — | 7 | 13 |
| J26 | — | — | 0.0030 | — | 10 | 15 |
| J27 | — | — | 0.0020 | — | 8 | 8 |
| J28 | — | — | 0.0040 | — | 8 | 8 |
| J29 | — | — | 0.0010 | — | 9 | 12 |

TABLE 12

(Continuation 11 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| Example of Invention | | | | | |
| J10 | 9 | 9 | 9 | 5 | 8.0 |
| J11 | 10 | 6 | 12 | 6 | 8.0 |
| J12 | 8 | 9 | 8 | 9 | 9.0 |
| J13 | 6 | 7 | 8 | 7 | 7.0 |
| J14 | 7 | 6 | 7 | 8 | 7.0 |
| J15 | 6 | 6 | 8 | 6 | 9.0 |
| J16 | 8 | 9 | 7 | 8 | 9.0 |
| J17 | 5 | 10 | 5 | 10 | 8.5 |
| J18 | 10 | 9 | 12 | 11 | 8.1 |
| J19 | 7 | 6 | 7 | 6 | 9.0 |
| J20 | 10 | 10 | 12 | 12 | 9.0 |
| J21 | 5 | 9 | 5 | 9 | 9.0 |
| J22 | 10 | 9 | 12 | 15 | 9.0 |
| J23 | 8 | 10 | 8 | 10 | 7.0 |
| J24 | 10 | 9 | 12 | 14 | 9.5 |
| J25 | 8 | 6 | 8 | 6 | 9.0 |
| J26 | 6 | 8 | 8 | 12 | 9.0 |
| J27 | 9 | 9 | 9 | 9 | 8.0 |
| J28 | 10 | 6 | 12 | 11 | 8.4 |
| J29 | 8 | 9 | 8 | 9 | 9.0 |

TABLE 13

(Continuation 12 of Table 1)

| No. | C | Si | Mn | P | S | Cr | Ni | Mo |
|---|---|---|---|---|---|---|---|---|
| Example of Invention | | | | | | | | |
| J30 | 0.11 | 0.380 | 0.30 | 0.018 | 0.009 | 3.00 | — | 1.00 |
| J31 | 0.13 | 0.020 | 1.10 | 0.007 | 0.001 | 2.90 | — | 0.20 |
| J32 | 0.14 | 0.020 | 0.90 | 0.005 | 0.007 | 2.70 | — | 1.00 |
| J33 | 0.12 | 0.400 | 1.40 | 0.003 | 0.009 | 5.80 | — | 0.30 |
| J34 | 0.03 | 0.110 | 0.90 | 0.008 | 0.009 | 3.10 | — | 0.10 |
| J35 | 0.05 | 0.430 | 1.40 | 0.008 | 0.007 | 5.70 | 0.40 | — |
| J36 | 0.13 | 0.370 | 0.60 | 0.016 | 0.002 | 5.60 | 2.50 | — |
| J37 | 0.07 | 0.490 | 0.40 | 0.011 | 0.002 | 4.00 | 2.20 | — |
| J38 | 0.02 | 0.020 | 1.50 | 0.013 | 0.008 | 4.10 | 1.30 | — |
| J39 | 0.02 | 0.360 | 0.90 | 0.004 | 0.007 | 4.70 | 2.30 | — |
| J40 | 0.08 | 0.300 | 1.50 | 0.010 | 0.008 | 4.00 | 0.80 | — |
| J41 | 0.07 | 0.360 | 0.20 | 0.017 | 0.002 | 3.80 | 0.80 | — |

TABLE 13-continued (Continuation 12 of Table 1)

| No. | C | Si | Mn | P | S | Cr | Ni | Mo |
|---|---|---|---|---|---|---|---|---|
| J42 | 0.09 | 0.230 | 0.10 | 0.008 | 0.007 | 3.50 | 0.10 | — |
| J43 | 0.07 | 0.430 | 1.20 | 0.025 | 0.005 | 6.20 | 0.80 | — |
| J44 | 0.11 | 0.150 | 0.40 | 0.010 | 0.005 | 4.40 | 1.10 | — |
| J45 | 0.09 | 0.130 | 0.60 | 0.012 | 0.003 | 3.50 | 2.50 | — |
| J46 | 0.04 | 0.090 | 1.30 | 0.021 | 0.010 | 6.10 | 2.10 | — |
| J47 | 0.05 | 0.180 | 1.00 | 0.017 | 0.006 | 5.60 | 1.60 | — |
| J48 | 0.07 | 0.040 | 1.10 | 0.007 | 0.007 | 6.20 | 1.70 | — |
| J49 | 0.08 | 0.210 | 1.10 | 0.013 | 0.009 | 2.90 | 1.40 | — |

TABLE 14

(Continuation 13 of Table 1)

| No. | Ti | Al | Cu | Nb | V | Ta | Zr | B |
|---|---|---|---|---|---|---|---|---|
| Example of Invention | | | | | | | | |
| J30 | 0.045 | 0.054 | — | — | — | — | — | — |
| J31 | 0.005 | 0.084 | — | — | — | — | — | |
| J32 | 0.050 | 0.065 | — | — | — | — | — | — |
| J33 | 0.050 | 0.005 | — | — | — | — | — | — |
| J34 | 0.050 | 0.100 | — | — | — | — | — | — |
| J35 | 0.050 | 0.089 | 1.00 | — | — | — | — | — |
| J36 | 0.050 | 0.018 | — | 0.005 | — | — | — | — |
| J37 | 0.050 | 0.008 | — | 0.100 | — | — | — | — |
| J38 | 0.050 | 0.060 | — | — | 0.005 | — | — | — |
| J39 | 0.047 | 0.093 | — | — | 0.100 | — | — | — |
| J40 | 0.050 | 0.061 | — | — | — | 0.005 | — | — |
| J41 | 0.050 | 0.062 | — | — | — | 0.100 | — | — |
| J42 | 0.050 | 0.091 | — | — | — | — | 0.01 | — |
| J43 | 0.050 | 0.020 | — | — | — | — | 0.10 | — |
| J44 | 0.033 | 0.064 | — | — | — | — | — | — |
| J45 | 0.015 | 0.028 | — | — | — | — | — | — |
| J46 | 0.005 | 0.018 | — | — | — | — | — | 0.0003 |
| J47 | 0.008 | 0.010 | — | — | — | — | — | 0.0050 |
| J48 | 0.045 | 0.034 | — | — | — | — | — | — |
| J49 | 0.050 | 0.079 | — | — | — | — | — | — |

TABLE 15

(Continuation 14 of Table 1)

| No. | REM | Ca | N | Others | Rust weight in D&D | Rust weight in chimney exposure |
|---|---|---|---|---|---|---|
| J30 | — | — | 0.0050 | — | 3 | 8 |
| J31 | — | — | 0.0040 | — | 9 | 8 |
| J32 | — | — | 0.0050 | — | 3 | 11 |
| J33 | — | — | 0.0030 | — | 8 | 8 |
| J34 | — | — | 0.0020 | — | 6 | 9 |
| J35 | — | — | 0.0025 | — | 7 | 15 |
| J36 | — | — | 0.0015 | — | 8 | 10 |
| J37 | — | — | 0.0040 | — | 3 | 12 |
| J38 | — | — | 0.0010 | — | 4 | 13 |
| J39 | — | — | 0.0040 | — | 10 | 8 |
| J40 | — | — | 0.0010 | — | 5 | 11 |
| J41 | — | — | 0.0050 | — | 7 | 11 |
| J42 | — | — | 0.0040 | — | 5 | 7 |
| J43 | — | — | 0.0050 | — | 9 | 8 |
| J44 | — | — | 0.0030 | — | 7 | 10 |
| J45 | — | — | 0.0020 | — | 5 | 11 |
| J46 | — | — | 0.0025 | — | 7 | 8 |
| J47 | — | — | 0.0015 | — | 6 | 7 |
| J48 | 0.0003 | — | 0.0050 | — | 9 | 12 |
| J49 | 0.0050 | — | 0.0030 | — | 8 | 12 |

TABLE 16

(Continuation 15 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| Example of Invention | | | | | |
| J30 | 6 | 7 | 8 | 13 | 7.0 |
| J31 | 7 | 6 | 7 | 6 | 7.0 |
| J32 | 6 | 6 | 8 | 10 | 9.0 |
| J33 | 8 | 9 | 8 | 9 | 8.8 |
| J34 | 5 | 10 | 7 | 11 | 8.0 |
| J35 | 6 | 8 | 6 | 8 | 9.0 |
| J36 | 6 | 7 | 8 | 11 | 9.0 |
| J37 | 6 | 8 | 6 | 8 | 9.0 |
| J38 | 10 | 8 | 9 | 12 | 7.8 |
| J39 | 6 | 6 | 6 | 6 | 8.8 |
| J40 | 9 | 6 | 9 | 6 | 8.0 |
| J41 | 8 | 7 | 8 | 7 | 7.0 |
| J42 | 7 | 6 | 7 | 6 | 7.0 |
| J43 | 5 | 10 | 5 | 10 | 7.0 |
| J44 | 10 | 6 | 10 | 6 | 8.0 |
| J45 | 9 | 9 | 9 | 9 | 8.0 |
| J46 | 7 | 5 | 7 | 5 | 9.0 |
| J47 | 9 | 8 | 9 | 8 | 7.0 |
| J48 | 6 | 10 | 6 | 10 | 8.0 |
| J49 | 10 | 5 | 10 | 5 | 8.0 |

TABLE 17

(Continuation 16 of Table 1)

| No. | C | Si | Mn | P | S | Cr | Ni | Mo |
|---|---|---|---|---|---|---|---|---|
| Example of Invention | | | | | | | | |
| J50 | 0.09 | 0.090 | 0.90 | 0.007 | 0.002 | 4.10 | 2.50 | — |
| J51 | 0.11 | 0.060 | 0.80 | 0.017 | 0.006 | 2.60 | 0.50 | — |
| J52 | 0.04 | 0.290 | 0.20 | 0.012 | 0.005 | 3.40 | 1.50 | — |
| J53 | 0.05 | 0.430 | 1.40 | 0.008 | 0.007 | 5.70 | — | 0.80 |
| J54 | 0.13 | 0.370 | 0.60 | 0.016 | 0.002 | 5.60 | — | 0.50 |
| J55 | 0.07 | 0.490 | 0.40 | 0.011 | 0.002 | 4.00 | — | 0.30 |
| J56 | 0.02 | 0.020 | 1.50 | 0.013 | 0.008 | 4.10 | — | 0.40 |
| J57 | 0.02 | 0.360 | 0.90 | 0.004 | 0.007 | 4.70 | — | 0.80 |
| J58 | 0.08 | 0.300 | 1.50 | 0.010 | 0.008 | 4.00 | — | 0.20 |
| J59 | 0.07 | 0.360 | 0.20 | 0.017 | 0.002 | 3.80 | — | 0.90 |
| J60 | 0.09 | 0.230 | 0.10 | 0.008 | 0.007 | 3.50 | — | 0.80 |
| J61 | 0.07 | 0.430 | 1.20 | 0.025 | 0.005 | 6.20 | — | 0.80 |
| J62 | 0.11 | 0.150 | 0.40 | 0.010 | 0.005 | 4.40 | — | 0.70 |
| J63 | 0.09 | 0.130 | 0.60 | 0.012 | 0.003 | 3.50 | — | 1.00 |
| J64 | 0.04 | 0.090 | 1.30 | 0.021 | 0.010 | 6.10 | — | 0.90 |
| J65 | 0.05 | 0.180 | 1.00 | 0.017 | 0.006 | 5.60 | — | 0.50 |
| J66 | 0.07 | 0.040 | 1.10 | 0.007 | 0.007 | 6.20 | — | 0.40 |
| J67 | 0.08 | 0.210 | 1.10 | 0.013 | 0.009 | 2.90 | — | 0.80 |
| J68 | 0.09 | 0.090 | 0.90 | 0.007 | 0.002 | 4.10 | — | 0.50 |
| J69 | 0.11 | 0.060 | 0.80 | 0.017 | 0.006 | 2.60 | — | 1.00 |

TABLE 18

(Continuation 17 of Table 1)

| No. | Ti | Al | Cu | Nb | V | Ta | Zr | B |
|---|---|---|---|---|---|---|---|---|
| Example of Invention | | | | | | | | |
| J50 | 0.032 | 0.083 | — | — | — | — | — | — |
| J51 | 0.050 | 0.041 | — | — | — | — | — | — |
| J52 | 0.031 | 0.008 | — | — | — | — | — | — |

TABLE 18-continued (Continuation 17 of Table 1)

| No. | Ti | Al | Cu | Nb | V | Ta | Zr | B |
|---|---|---|---|---|---|---|---|---|
| J53 | 0.050 | 0.089 | 1.00 | — | — | — | — | — |
| J54 | 0.050 | 0.018 | — | 0.005 | — | — | — | — |
| J55 | 0.050 | 0.008 | — | 0.100 | — | — | — | — |
| J56 | 0.050 | 0.060 | — | — | 0.005 | — | — | — |
| J57 | 0.047 | 0.093 | — | — | 0.100 | — | — | — |
| J58 | 0.050 | 0.061 | — | — | — | 0.005 | — | — |
| J59 | 0.050 | 0.062 | — | — | — | 0.100 | — | — |
| J60 | 0.050 | 0.091 | — | — | — | — | 0.01 | — |
| J61 | 0.050 | 0.020 | — | — | — | — | 0.10 | — |
| J62 | 0.033 | 0.064 | — | — | — | — | — | — |
| J63 | 0.015 | 0.028 | — | — | — | — | — | — |
| J64 | 0.005 | 0.018 | — | — | — | — | — | 0.0003 |
| J65 | 0.008 | 0.010 | — | — | — | — | — | 0.0050 |
| J66 | 0.045 | 0.034 | — | — | — | — | — | — |
| J67 | 0.050 | 0.079 | — | — | — | — | — | — |
| J68 | 0.032 | 0.083 | — | — | — | — | — | — |
| J69 | 0.050 | 0.041 | — | — | — | — | — | — |

TABLE 19

(Continuation 18 of Table 1)

| No. | REM | Ca | N | Others | Rust weight in D&D | Rust weight in chimney exposure |
|---|---|---|---|---|---|---|
| Example of Invention | | | | | | |
| J50 | — | 0.0003 | 0.0020 | — | 6 | 8 |
| J51 | — | 0.0600 | 0.0025 | — | 3 | 14 |
| J52 | — | — | 0.0070 | — | 3 | 5 |
| J53 | — | — | 0.0020 | — | 7 | 15 |
| J54 | — | — | 0.0025 | — | 8 | 10 |
| J55 | — | — | 0.0015 | — | 3 | 12 |
| J56 | — | — | 0.0040 | — | 4 | 13 |
| J57 | — | — | 0.0010 | — | 10 | 8 |
| J58 | — | — | 0.0050 | — | 5 | 11 |
| J59 | — | — | 0.0040 | — | 7 | 11 |
| J60 | — | — | 0.0050 | — | 5 | 7 |
| J61 | — | — | 0.0030 | — | 9 | 8 |
| J62 | — | — | 0.0020 | — | 7 | 10 |
| J63 | — | — | 0.0040 | — | 5 | 11 |
| J64 | — | — | 0.0010 | — | 7 | 8 |
| J65 | — | — | 0.0050 | — | 6 | 7 |
| J66 | 0.0003 | — | 0.0040 | — | 9 | 12 |
| J67 | 0.0050 | — | 0.0050 | — | 8 | 12 |
| J68 | — | 0.0003 | 0.0030 | — | 6 | 8 |
| J69 | — | 0.0600 | 0.0020 | — | 3 | 14 |

TABLE 20

(Continuation 19 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| Example of Invention | | | | | |
| J50 | 8 | 6 | 8 | 6 | 8.0 |
| J51 | 7 | 9 | 7 | 9 | 8.5 |
| J52 | 9 | 9 | 9 | 9 | 8.3 |
| J53 | 6 | 8 | 6 | 8 | 9.0 |
| J54 | 6 | 7 | 6 | 7 | 8.7 |

TABLE 20-continued (Continuation 19 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| J55 | 6 | 8 | 6 | 8 | 9.0 |
| J56 | 10 | 8 | 10 | 8 | 9.0 |
| J57 | 6 | 6 | 6 | 6 | 8.4 |
| J58 | 9 | 6 | 9 | 6 | 8.0 |
| J59 | 8 | 7 | 8 | 7 | 7.0 |
| J60 | 7 | 6 | 7 | 6 | 7.5 |
| J61 | 5 | 10 | 5 | 10 | 7.0 |
| J62 | 10 | 6 | 10 | 6 | 8.0 |
| J63 | 9 | 9 | 9 | 9 | 7.3 |
| J64 | 7 | 5 | 7 | 5 | 9.0 |
| J65 | 9 | 8 | 9 | 8 | 7.0 |
| J66 | 6 | 10 | 6 | 10 | 7.9 |
| J67 | 10 | 5 | 10 | 5 | 8.0 |
| J68 | 8 | 6 | 8 | 6 | 8.0 |
| J69 | 7 | 9 | 7 | 9 | 7.8 |

TABLE 21

(Continuation 20 of Table 1)

| No. | C | Si | Mn | P | S | Cr | Ni | Mo |
|---|---|---|---|---|---|---|---|---|
| Example of Invention | | | | | | | | |
| J70 | 0.11 | 0.070 | 1.20 | 0.016 | 0.004 | 5.20 | — | 0.80 |
| J71 | 0.04 | 0.290 | 0.20 | 0.012 | 0.005 | 3.40 | — | 0.20 |
| J72 | 0.05 | 0.300 | 0.50 | 0.005 | 0.005 | 4.90 | 0.30 | — |
| J73 | 0.04 | 0.290 | 0.51 | 0.003 | 0.003 | 5.10 | — | 0.50 |
| J74 | 0.10 | 0.130 | 1.10 | 0.016 | 0.002 | 4.50 | 1.49 | — |
| J75 | 0.05 | 0.030 | 1.20 | 0.022 | 0.005 | 2.90 | 1.10 | 1.00 |
| J76 | 0.02 | 0.340 | 1.00 | 0.011 | 0.007 | 3.50 | 2.30 | 0.30 |
| J77 | 0.13 | 0.280 | 1.30 | 0.014 | 0.002 | 3.10 | 1.70 | — |
| J78 | 0.13 | 0.360 | 0.70 | 0.024 | 0.004 | 3.10 | 1.60 | — |
| J79 | 0.07 | 0.290 | 0.20 | 0.017 | 0.003 | 4.00 | 0.40 | — |
| J80 | 0.14 | 0.330 | 1.10 | 0.013 | 0.003 | 5.30 | 0.50 | — |
| J81 | 0.05 | 0.010 | 0.30 | 0.020 | 0.005 | 4.60 | 0.30 | — |
| J82 | 0.08 | 0.360 | 1.40 | 0.020 | 0.004 | 4.00 | 0.30 | — |
| J83 | 0.05 | 0.240 | 0.70 | 0.013 | 0.010 | 3.30 | 1.10 | — |
| J84 | 0.14 | 0.100 | 1.10 | 0.011 | 0.008 | 4.30 | 1.40 | — |
| J85 | 0.11 | 0.380 | 0.90 | 0.019 | 0.007 | 5.40 | 0.50 | — |
| J86 | 0.04 | 0.240 | 0.50 | 0.018 | 0.007 | 3.80 | 2.30 | 0.80 |
| J87 | 0.02 | 0.330 | 0.10 | 0.022 | 0.003 | 2.60 | 0.20 | 0.50 |
| J88 | 0.13 | 0.020 | 1.00 | 0.003 | 0.008 | 3.30 | 1.80 | 1.00 |
| J89 | 0.12 | 0.310 | 0.60 | 0.015 | 0.005 | 5.70 | 1.30 | 0.80 |
| J90 | 0.03 | 0.200 | 0.50 | 0.010 | 0.005 | 5.0 | 0.30 | — |
| J91 | 0.09 | 0.5 | 0.60 | 0.025 | 0.010 | 6.0 | 0.50 | — |
| J92 | 0.01 | 0.05 | 0.30 | 0.010 | 0.005 | 4.0 | 0.15 | — |

TABLE 22

(Continuation 21 of Table 1)

| No. | Ti | Al | Cu | Nb | V | Ta | Zr | B |
|---|---|---|---|---|---|---|---|---|
| Example of Invention | | | | | | | | |
| J70 | 0.042 | 0.047 | — | — | — | — | — | — |
| J71 | 0.031 | 0.008 | — | — | — | — | — | — |
| J72 | 0.009 | 0.015 | 0.31 | — | — | — | — | — |
| J73 | 0.012 | 0.011 | — | — | — | — | — | — |
| J74 | 0.011 | 0.014 | — | — | — | — | — | — |
| J75 | 0.050 | 0.039 | — | — | — | — | — | — |
| J76 | 0.050 | 0.088 | 0.50 | — | — | — | — | — |
| J77 | 0.035 | 0.067 | 0.67 | 0.068 | — | — | — | — |

TABLE 22-continued (Continuation 21 of Table 1)

| No. | Ti | Al | Cu | Nb | V | Ta | Zr | B |
|---|---|---|---|---|---|---|---|---|
| J78 | 0.050 | 0.081 | 0.83 | — | 0.069 | — | — | — |
| J79 | 0.050 | 0.053 | 0.27 | — | — | 0.067 | — | — |
| J80 | 0.026 | 0.095 | — | — | — | — | 0.08 | — |
| J81 | 0.050 | 0.024 | — | — | — | — | — | 0.0010 |
| J82 | 0.050 | 0.049 | 0.24 | — | — | — | — | — |
| J83 | 0.050 | 0.091 | 0.66 | — | — | — | — | — |
| J84 | 0.037 | 0.091 | 0.20 | — | — | — | — | — |
| J85 | 0.038 | 0.019 | 0.82 | 0.083 | 0.040 | 0.020 | 0.01 | 0.0042 |
| J86 | 0.050 | 0.089 | 0.75 | — | — | — | 0.01 | — |
| J87 | 0.050 | 0.019 | 0.73 | 0.041 | 0.070 | 0.071 | 0.03 | — |
| J88 | 0.050 | 0.075 | 0.22 | 0.073 | 0.084 | 0.028 | 0.03 | — |
| J89 | 0.050 | 0.098 | 0.24 | 0.100 | 0.091 | 0.058 | 0.09 | 0.0043 |
| J90 | 0.009 | 0.020 | 0.30 | — | — | — | — | — |
| J91 | 0.008 | 0.020 | 0.5 | — | — | — | — | — |
| J92 | 0.005 | 0.005 | 0.15 | — | — | — | — | — |

TABLE 23

(Continuation 22 of Table 1)

| No. | REM | Ca | N | Others | Rust weight in D&D | Rust weight in chimney exposure |
|---|---|---|---|---|---|---|
| Example of Invention | | | | | | |
| J70 | — | — | 0.0025 | — | 10 | 7 |
| J71 | — | — | 0.0015 | — | 3 | 5 |
| J72 | — | — | 0.0040 | — | 7 | 6 |
| J73 | — | — | 0.0010 | — | 3 | 14 |
| J74 | — | — | 0.0040 | — | 8 | 12 |
| J75 | — | — | 0.0010 | — | 10 | 10 |
| J76 | — | — | 0.0050 | — | 7 | 9 |
| J77 | — | — | 0.0040 | — | 7 | 6 |
| J78 | — | — | 0.0050 | — | 8 | 9 |
| J79 | — | — | 0.0030 | — | 9 | 7 |
| J80 | — | 0.0431 | 0.0020 | — | 6 | 13 |
| J81 | — | — | 0.0025 | — | 5 | 10 |
| J82 | — | 0.0323 | 0.0015 | — | 7 | 11 |
| J83 | 0.0025 | 0.0516 | 0.0050 | — | 6 | 7 |
| J84 | — | 0.0474 | 0.0030 | — | 6 | 11 |
| J85 | — | 0.0485 | 0.0020 | — | 8 | 15 |
| J86 | 0.0021 | 0.0154 | 0.0025 | — | 4 | 11 |
| J87 | — | 0.0501 | 0.0015 | — | 9 | 9 |
| J88 | 0.0007 | 0.0600 | 0.0050 | — | 6 | 6 |
| J89 | 0.0009 | 0.0116 | 0.0030 | — | 6 | 12 |
| J90 | — | — | — | — | 7 | 9 |
| J91 | — | — | — | — | 8 | 8 |
| J92 | — | — | — | — | 9 | 12 |

TABLE 24

(Continuation 23 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| Example of Invention | | | | | |
| J70 | 10 | 8 | 10 | 8 | 9.0 |
| J71 | 9 | 9 | 9 | 9 | 7.0 |
| J72 | 7 | 9 | 7 | 9 | 7.5 |
| J73 | 9 | 6 | 9 | 6 | 9.0 |

TABLE 24-continued (Continuation 23 of Table 1)

| No. | Weight loss by corrosion in D&D | Weight loss by corrosion in chimney exposure | Max. erosion depth in D&D | Max. erosion depth in chimney exposure | Joint toughness vEO kgf-m |
|---|---|---|---|---|---|
| J74 | 6 | 8 | 6 | 8 | 8.0 |
| J75 | 6 | 9 | 6 | 9 | 9.0 |
| J76 | 9 | 6 | 9 | 6 | 8.0 |
| J77 | 8 | 7 | 8 | 7 | 8.0 |
| J78 | 7 | 6 | 7 | 6 | 8.0 |
| J79 | 6 | 6 | 6 | 6 | 7.0 |
| J80 | 7 | 6 | 7 | 6 | 7.0 |
| J81 | 8 | 8 | 8 | 8 | 9.0 |
| J82 | 9 | 7 | 9 | 7 | 8.0 |
| J83 | 5 | 8 | 5 | 8 | 9.0 |
| J84 | 8 | 10 | 8 | 10 | 9.0 |
| J85 | 6 | 6 | 6 | 6 | 8.0 |
| J86 | 9 | 7 | 9 | 7 | 7.0 |
| J87 | 7 | 6 | 7 | 6 | 8.0 |
| J88 | 7 | 9 | 7 | 9 | 8.0 |
| J89 | 5 | 9 | 5 | 9 | 8.0 |
| J90 | 7 | 8 | 6 | 9 | 24.0 |
| J91 | 6 | 7 | 8 | 8 | 20.1 |
| J92 | 9 | 9 | 9 | 10 | 21.2 |

TABLE 25

| Chemical composition of test solution | | | |
|---|---|---|---|
| $(NH_4)_2SO_4$ (ppm) | $Na_2SO_4$ (ppm) | NaCl (ppm) | pH |
| 440 | 140 | 40 | 4 ± 0.3 |

| Test conditions | | | |
|---|---|---|---|
| Dip | | Dry | |
| Temp. (°C.) | Time (min) | Temp. (°C.) | Time (min) |
| 55 | 2 | 55 | 58 |

Simulated combustion waste gas vent.: None
Replenishment of solution during test: pH-adjusted distilled water
Test cycles: 236 cycles (hr)

From the results for Comparative Example C03 it is found that, with a carbon content more than 0.15%, the absorbed energy is less than 2.8 kgf-m.

From the results for Comparative Example C04 it is found that, with a silicon content less than 0.01%, the absorbed energy is less than 2.8 kgf-m.

From the results for Comparative Example C05 it is found that, with a silicon content more than 0.5%, the absorbed energy is less than 2.8 kgf-m.

From the results for Comparative Examples C06 and C18 it is found that, with a manganese content less than 0.1%, the absorbed energy is less than 2.8 kgf-m.

From the results for Comparative Examples C07 and C19 it is found that, with a manganese content more than 1.5%, the absorbed energy is less than 2.8 kgf-m.

From the results for Comparative Examples C08 and C20 it is found that, with a phosphorus content more than 0.025%, no remarkable decrease in the amount of rust is observed and the absorbed energy is less than 2.8 kgf-m.

From the results for Comparative Examples C09 and C21 it is found that, with a sulfur content more than 0.010%, no remarkable decrease in the amount of rust is observed and the absorbed energy is less than 2.8 kgf-m.

From the results for Comparative Examples C10 and C22 it is found that, with a chromium content less than 2.5%, the weight loss by corrosion and the amount of rust in the chimney exposure test are larger than those in Example C02 (JIS G3141 SM400).

From the results for Comparative Examples C11 and C23 it is found that, with a chromium content more than 7.0%, the absorbed energy is less than 2.8 kgf-m.

From the results for Comparative Example C12 it is found that, with a nickel content less than 0.05 wt. %, no remarkable decrease in the amount of rust is observed.

From the results for Comparative Examples C13 and C25 it is found that, with a titanium content less than 0.005%, no remarkable decrease in the amount of rust is observed.

From the results for Comparative Examples C14, C26 and C28 it is found that, with a titanium content more than 0.05%, the absorbed energy is less than 2.8 kgf-m.

From the results for Comparative Examples C15, C27 and C29 it is found that, with an aluminum content less than 0.005%, the absorbed energy is less than 2.8 kgf-m.

From the results for Comparative Examples C16 and C30 it is found that, with an aluminum content more than 0.1%, the absorbed energy is less than 2.8 kgf-m.

From the results for Comparative Example C17 it is found that, with a copper content less than 0.1% in the case of the combined addition of Cu—Ni, no remarkable decrease in the amount of rust is observed.

From the results for Comparative Example C24 it is found that, with a molybdenum content less than 0.1 wt. %, no remarkable improvement in rust adhesion is observed as apparent from an amount of rust of 90 to 91.

From the results for Examples of Invention J01 to J89 it is found that the weight of peeling-off rust, weight loss by corrosion and maximum erosion depth are less than one fourth as low as those in Comparative Examples C01 to C30 and that the absorbed energy is not less than 7.0 kgf-m.

As is clear from these results, in comparison with the sulfuric acid dew point corrosion resistant low-alloy steel, Examples of the Invention reveal that the steel of the present invention for a chimney or a gas duct is excellent in rust adhesion, corrosion resistance and pitting resistance, each of which properties is more than four times as high as those of the sulfuric acid dew point corrosion resistant low-alloy steel, and has a sufficient joint toughness suitable as a steel for welded structures.

As is evident from the above-mentioned Examples, the steel of the present invention, applicable as a member for a chimney or a gas duct for burning natural gas, have a rust adhesion, a pitting resistance and a corrosion resistance more than four times as high as those of the conventional sulfuric acid dew point corrosion resistant low-alloy steel or an ordinary steel for welded structures, is far lower in cost than a sulfuric acid dew point corrosion resistant stainless steel, has a sufficient joint toughness as a steel for welded structures, and is applicable as a structural member for a chimney cylinder or a gas duct without being subjected to any other corrosion-preventive treatment, thus eliminating the necessity of a lining. It is thus possible to remarkably reduce the plant construction cost, the amount of fine dust in waste gas, and the maintenance cost, thus providing industrially very useful effects.

What is claimed is:

1. A steel for a chimney or a gas duct, excellent in pitting resistance and rust adhesion, consisting essentially of, by weight:

0.01 to 0.15% carbon;

0.01 to 0.5% silicon;

0.1 to 1.5% manganese;

not more than 0.025% phosphorus;

not more than 0.010% sulfur;

not less than 2.5 but not more than 7.0% chromium;

1.0 to 2.5% nickel;

0.005 to 0.05% titanium;

0.0003 to 0.06% calcium;

0.005 to 0.1% aluminum; and the balance being iron and incidental impurities.

2. A steel for a chimney or a gas duct, excellent in pitting resistance and rust adhesion, as claimed in claim 1, wherein said steel further contains, by weight, at least one selected from the group consisting of 0.10 to 1.0% copper, and 0.10 to 1.0% molybdenum.

3. A steel for a chimney or a gas duct, excellent in pitting resistance and rust adhesion, consisting essentially of, by weight:

0.01 to 0.15% carbon;

0.01 to 0.5% silicon;

0.1 to 1.5% manganese;

not more than 0.025% phosphorus;

not more than 0.010% sulfur;

not less than 2.5 less than 7.0% chromium;

less than 1.0% nickel;

0.005 to 0.05% titanium;

0.005 to 0.1% aluminum;

0.0003 to 0.06% calcium;

at least one selected from the group consisting of 0.10 to 1.0% copper and 0.10 to 1.0% molybdenum; and the balance being iron and incidental impurities.

4. A steel for a chimney or a gas duct, excellent in pitting resistance and rust adhesion, consisting essentially of, by weight:

0.01 to 0.15% carbon;

0.01 to 0.5% silicon;

0.1 to 1.5% manganese;

not more than 0.025% phosphorus;

not more than 0.010% sulfur;

not less than 2.5 but less than 7.0% chromium;

0.1 to 1.0% molybdenum 0.005 to 0.05% titanium;

0.0003 to 0.06% calcium;

0.005 to 0.1% aluminum; and the balance being iron and incidental impurities.

5. A steel for a chimney or a gas duct, excellent in pitting resistance and rust adhesion, as claimed in claim 4, wherein said steel further contains 0.10 to 1.0 wt. % copper.

6. A steel for a chimney or a gas duct, excellent in pitting resistance and rust adhesion, as claimed in any one of claims 1 to 5, wherein said steel further contains at least one selected from the group consisting, by weight, of:

0.005 to 0.1% niobium;

0.005 to 0.1% vanadium; and 0.001 to 0.1% tantalum, and/or contains 0.0003 to 0.0050 wt. % boron.

7. A steel for a chimney or a gas duct, excellent in pitting resistance and rust adhesion, as claimed in claim 6, wherein said steel further contains at least one selected from the group consisting, by weight, of:

0.0003 to 0.0050% REM, and 0.0002 to 0.10% zirconium.

8. A steel for a chimney or a gas duct, excellent in pitting resistance and rust adhesion, as claimed in any one of claims 1 to 5, wherein said steel further contains at least one selected from the group consisting, by weight, of:

0.0003 to 0.0050% REM, and 0.0002 to 0.10% zirconium.

* * * * *